United States Patent [19]

Maier

[11] 4,010,562

[45] Mar. 8, 1977

[54] EMBROIDERY HOOP HOLDER

[76] Inventor: Henry K. Maier, 31 Morris Road, West Orange, N.J. 07052

[22] Filed: Aug. 5, 1976

[21] Appl. No.: 711,776

[52] U.S. Cl. ..... 38/102.2

[51] Int. Cl.[2] ..... D05C 1/04

[58] Field of Search ..... 269/1, 37, 45, 321 F; 38/102, 102.1, 102.2; 223/106, 120, 107; 248/125, 295, 316 C; 460/380

[56] References Cited

UNITED STATES PATENTS

| | | | |
|---|---|---|---|
| 744,070 | 11/1903 | Harmes | 38/102.2 |
| 840,232 | 1/1907 | McCombie | 38/102.2 |
| 3,309,803 | 3/1967 | Wilson | 38/102.2 |

*Primary Examiner*—G. V. Larkin

*Attorney, Agent, or Firm*—Hane, Sullivan & Spiecens

[57] ABSTRACT

A holder is provided for an embroidery hoop which has a grooved main portion in which is mounted the portion of the embroidery hoop that adjusts the tension of the outer hoop relative to the inner hoop. The main portion is supported by a pair of legs extending perpendicularly therefrom in a horizontal plane. When using the holder of the invention, the embroidery hoop itself acts as a frame with stand thereby obviating the use of a separate frame for the embroidered cloth. The groove in the main portion of the holder is of such depth and length as to cover partly or completely the adjusting portion of the embroidery hoop in order to display the embroidery hoop in an aesthetic fashion.

8 Claims, 13 Drawing Figures

EMBROIDERY HOOP HOLDER

BACKGROUND OF THE INVENTION

The present invention is directed to an embroidery stand for displaying a completed embroidery utilizing the embroidery hoop as a frame.

The art of forming decorative designs in embroidery requires that a cloth be held by an embroidery hoop during the process. Upon the completion of the embroidering, it is the customary fashion to frame the embroidered cloth in a purchaseable frame. Typically, the hoop is comprised of an inner and an outer ring, which receives therebetween the embroidered cloth.

SUMMARY OF THE INVENTION

It is the primary object of the present invention to provide an embroidery hoop holder which allows, in combination with a conventional embroidery hoop, for the use of the embroidery hoop as a frame after the completion of the embroidered cloth mounted within the embroidery hoop.

The holder of the present invention is specifically designed for use with a conventional embroidery hoop having a tensioning screw which adjusts the ends of the outer hoop in order to hold a cloth between the inner and outer hoops.

The embroidery holder of the present invention is comprised of a main portion in which is formed a groove for the reception therein of the conventional embroidery hoop. The groove is of such a depth and length as to cover partially or completely the tensioning screw of the conventional embroidery hoop. The holder of the invention is also provided with a pair of horizontal legs which support the main portion and allow for the display of the embroidery hoop.

The holder of the present invention obviates the need for the additional purchase of a separate frame on the part of an embroiderer, which has hitherto been necessary since the embroidery hoop itself has not been designed for display. The holder of the present invention allows for the conventional embroidery hoop to act as both a hoop for embroidery and as a frame for the subsequent display of the design. This dual purpose, as a consequence of the present invention, offers cost-savings to the consumer since he does not have to purchase a frame in addition to the embroidery hoop, and can offer, in addition an aesthetic appearance for display on a table, desk, vitrine, etc. as compared to conventional frames.

It can, furthermore, provide the conventional embroidery hoop with suitable designs or the like.

BRIEF DESCRIPTION OF THE DRAWING

The invention will be more readily understood with reference to the following detailed description when taken in conjunction with the accompanying Figures, wherein.

DETAILED DESCRIPTION OF THE INVENTION

Figure 1:
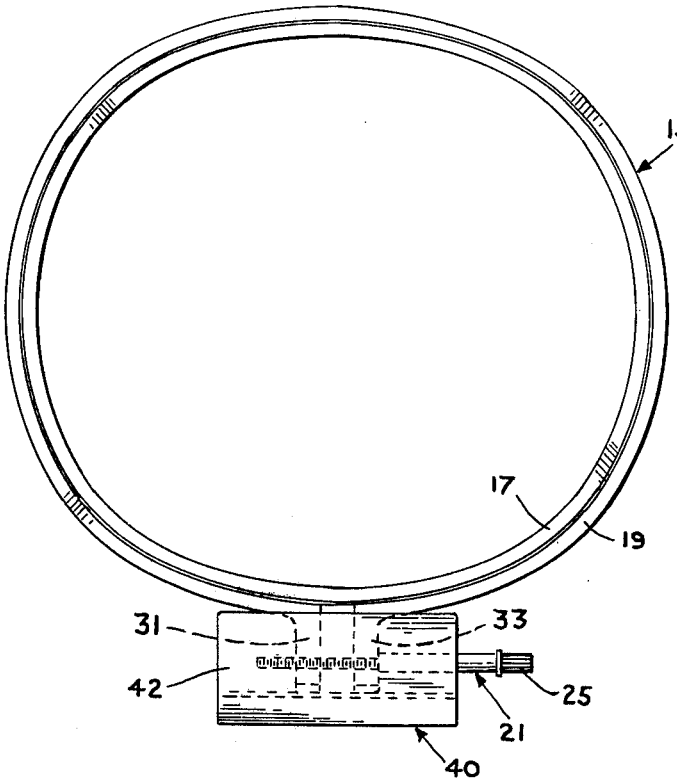
FIG. 1 is a plan view showing a conventional embroidery hoop in the embroidery holder of the invention.
Figure 13:
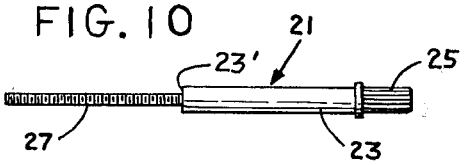
FIG. 13 shows the tension-adjusting screw used in the conventional embroidery hoop of FIG. 1.

FIG. 1 shows a conventional embroidery hoop 15 having an inner hoop 17 and an outer hoop 19. The inner hoop 17 fits within the outer hoop 19, the outer hoop 19 being adjustable by a tension-adjusting screw 21. The adjusting screw 21 is best seen in FIG. 13 and is comprised of a head portion 23 terminated in a knurled handle 25 for easy gripping, and a main threaded portion 27. The main portion 27 is received in a pair of flanges 31, 33 of outer hoop 19, one of which has a threaded opening 35 for mating engagement with the main threaded portion 27 of the screw 21, while the other flange has an aligned opening 37 which allows for the passage therethrough of the main threaded portion 27. It can, therefore, be seen that a cloth to be embroidered may be placed between the inner and outer hoops and firmly held therebetween by rotating the screw 21 so as to draw the flanges 31 and 33 closer together by the contact of the end face 23' against the flange 31 which has the non-threaded opening 37 formed therein. By reversely rotating the screw, the cloth may be removed or otherwise adjusted.

Figure 2:
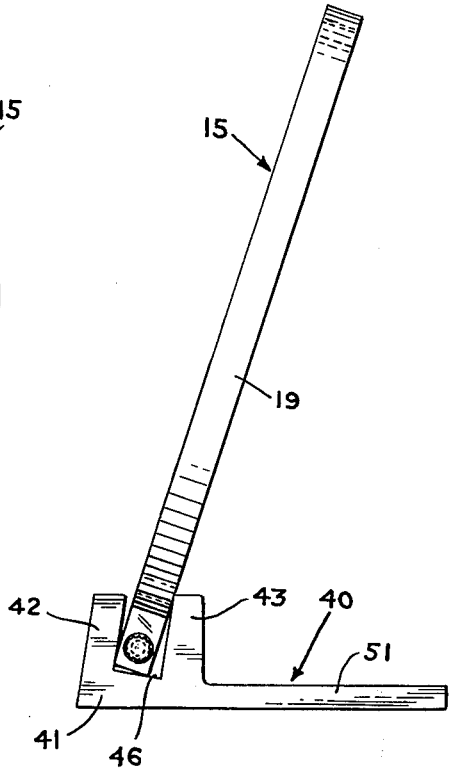
FIG. 2 is a side view of the hoop of FIG. 1 positioned in the embroidery holder of the present invention.
Figure 3:
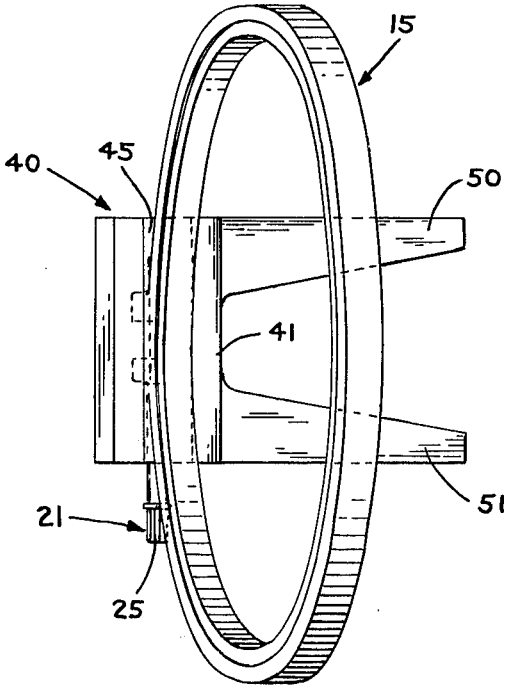
FIG. 3 is a top view of the hoop and holder combination of FIG. 2.
Figure 4:
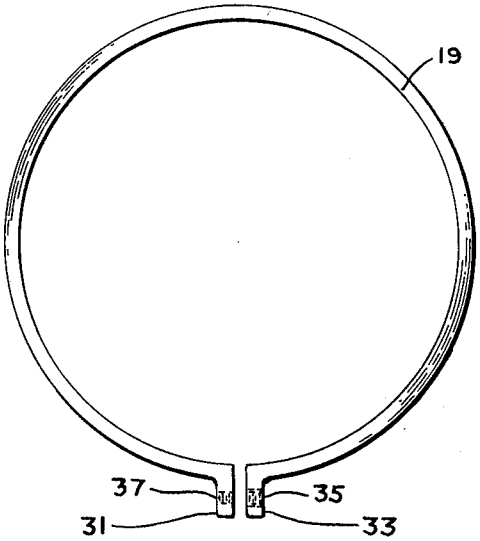
FIG. 4 is a plan view showing the outer hoop of the embroidery hoop of FIG. 1.
Figure 5:
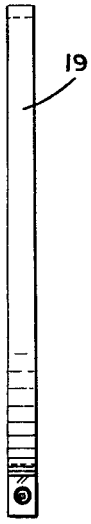
FIG. 5 is a side view of the outer hoop of FIG. 4.
Figure 6:
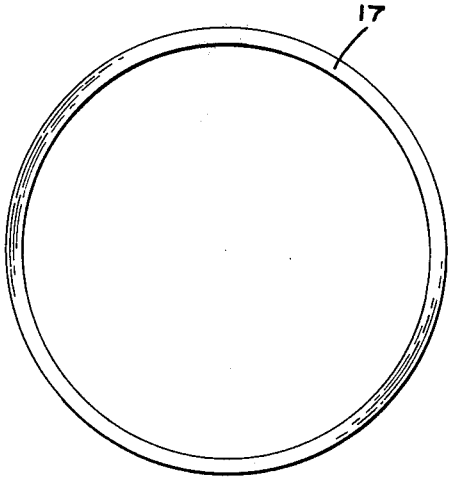
FIG. 6 is a plan view showing the inner hoop of the embroidery hoop of FIG. 1.
Figure 7:
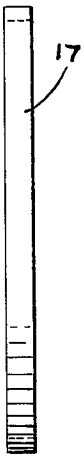
FIG. 7 is a side view of the inner hoop of FIG. 6.
Figure 8:
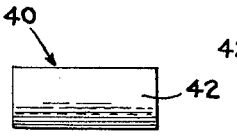
FIGS. 8–12 show the embroidery holder of the invention in greater detail.
Figure 9:
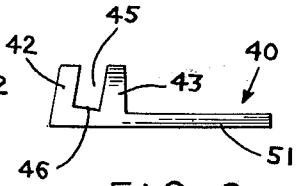
Figure 11:
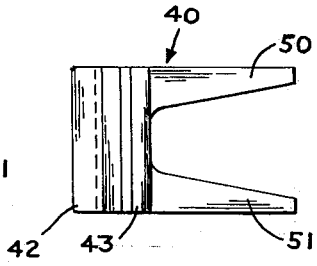
Figure 12:
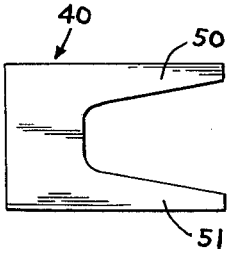
Figure 10:
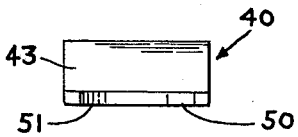

It has been conventional practice, after the cloth has been embroidered, to remove the cloth from the embroidery hoop and place it in a frame purchased expressly for that purpose. However, with the embroidery holder 40 of the present invention, the conventional embroidery hoop 15 may also be used as the frame which is mounted on the holder 40 for display. The holder 40 has a main portion 41 formed by a pair of upstanding walls 42, 43 which form therebetween a groove 45. The bottom surface 46 of the groove is slightly canted upwardly from wall 43 to wall 42, while the inner surfaces of the walls 42 and 43 are slanted at equal angles relative to a horizontal plane passing through the groove, as can be seen in FIG. 9. The canted surface 46 and the angled inner surfaces of the walls 42 and 43 serve to position the embroidery hoop 15 in the groove, so that it is slightly tilted in the forward direction, as can be seen in FIGS. 2 and 3, and so that the display thereof is enhanced. The upper portion of the wall 43 supports the hoop 15 in the groove and prevents it from falling out.

Extending perpendicularly from the wall 43 are a pair of horizontal legs 50, 51 which support the main portion 41. The legs 50 and 51 are of tapered width, narrowing in the direction away from the main portion 41, as can be seen in FIG. 3. Since the upper portion of the wall 43 and the lower portion of the wall 42 support the embroidery hoop 15 in the groove 45, the moments created thereby are balanced by the legs 50 and 51, so that the embroidery hoop 15 is firmly held in place without any tipping over of the holder.

The embroidery holder 40 of the invention may be made of wood, plastic or any other material, and may be molded integrally. It may be further provided with a design or pattern for aesthetic appearance. The embroidery hoop 15 may also be made of any desired material, and provided with a color, design or pattern matching with the color, design or pattern of the holder 40.

The groove 45 is of such a depth and length as to partially or completely cover the screw 21 and flanges 31, 33 when these are positioned in the groove for displaying the embroidery hoop 15.

While a specific embodiment of the invention has been shown and described, it is to be understood that numerous changes and modifications may be made without departing from the scope and spirit of the invention.

What is claimed is:

1. An embroidery hoop holder for use with an embroidery hoop having an inner hoop and an expandable outer hoop, and means for adjusting said outer hoop in order to position between said inner and outer hoops a cloth to be embroidered, comprising: a main portion having a groove formed therein for receiving a portion of said outer and inner hoops and said means for adjusting said outer hoop of said embroidery hoop; and means extending perpendicularly from said main portion for supporting said main portion so that when said embroidery hoop is mounted in said groove, the embroidery hoop will not cause the main portion to tip.

2. The embroidery hoop holder according to claim 1, wherein said main portion comprises a first wall and a second wall, each of said first and second walls having a slanted inner surface forming the side walls of said groove, and said groove having a canted bottom surface, whereby when said embroidery hoop is mounted in said groove it is supported in a forwardly tilted manner toward said means for supporting.

3. The embroidery hoop holder according to claim 2, wherein said means for supporting comprises a pair of horizontal legs extending from said first wall, said bottom surface of said groove being canted downwardly from said inner surface of said second wall toward said inner surface of said first wall.

4. The embroidery hoop holder according to claim 1, in combination with said embroidery hoop, said outer hoop comprising a pair of flanges extending from the ends thereof, one of said pair of flanges having a threaded opening formed therethrough, and the other of said pair of flanges having an opening in alignment with said threaded opening of said one flange, said means for adjusting said outer hoop comprising a screw extending through said threaded opening and said opening in alignment with said threaded opening, whereby upon the rotation of said screw said pair of flanges are either drawn toward or away from each other.

5. The embroidery hoop holder in combination with an embroidery hoop according to claim 4, wherein said groove has a depth at least equal to the extension of said pair of flanges from said ends of said outer hoop, so that the flanges are covered by said inner surfaces of said first and second walls.

6. The embroidery hoop holder in combination with an embroidery hoop according to claim 5, wherein said groove has a length at least equal to the length of said screw, so that said flanges and said screw are completely covered in said groove.

7. The embroidery hoop holder in combination with an embroidery hoop according to claim 4, wherein said main portion comprises a first wall and a second wall, each of said first and second walls having a slanted inner surface forming the side walls of said groove, and said groove having a canted bottom surface, whereby said embroidery hoop is supported in a forwardly tilted manner toward said means for supporting.

8. The embroidery hoop holder in combination with an embroidery hoop according to claim 7, wherein said means for supporting comprises a pair of horizontal legs extending from said first wall, said bottom surface of said groove being canted downwardly from said inner surface of said second wall toward said inner surface of said first wall.

* * * * *